United States Patent [19]

Boone

[11] Patent Number: 4,932,296

[45] Date of Patent: Jun. 12, 1990

[54] APPARATUS FOR CUTTING A CONTINUOUS STRIP OF LIMP MATERIAL

[76] Inventor: Everett C. Boone, P.O. Box 1054, Rocky Mount, Va. 24151

[21] Appl. No.: 301,630

[22] Filed: Jan. 25, 1989

[51] Int. Cl.[5] ..... B26D 5/20

[52] U.S. Cl. ..... 83/150; 83/209; 83/282; 83/418; 83/607; 83/701; 83/365

[58] Field of Search ..... 83/42, 282, 365, 371, 83/605, 601, 611, 697, 655, 694, 654, 652, 597, 606, 607, 609, 209, 210, 211, 418, 701, 367, 202, 150

[56] References Cited

U.S. PATENT DOCUMENTS

| | | | |
|---|---|---|---|
| 1,380,249 | 5/1921 | Rehfuss | 83/607 |
| 2,604,166 | 7/1952 | Turner | 83/611 |
| 2,751,005 | 6/1956 | Parmer | 83/605 |
| 2,854,234 | 9/1958 | Cotton | 271/2.4 |
| 2,945,957 | 7/1960 | Kelling | 250/219 |
| 3,010,864 | 11/1961 | Schneider et al. | 156/64 |
| 3,043,729 | 7/1962 | Seiden | 83/82 |
| 3,082,923 | 3/1963 | Ford et al. | 83/605 |
| 3,496,811 | 2/1970 | Flanagan et al. | 83/13 |
| 3,760,667 | 9/1973 | Maxey et al. | 83/13 |
| 3,807,270 | 4/1974 | Wirz | 83/605 |
| 4,034,634 | 7/1977 | Arbter | 83/18 |
| 4,043,232 | 8/1977 | Jovin | 83/13 |
| 4,321,103 | 3/1982 | Lindstrom et al. | 156/351 |
| 4,381,211 | 4/1983 | Nechay | 156/361 |
| 4,401,250 | 8/1983 | Carlsson | 226/33 |
| 4,601,225 | 7/1986 | Starnes et al. | 83/282 |
| 4,699,031 | 10/1987 | D'Angelo et al. | 83/282 |
| 4,717,059 | 1/1988 | Takahashi | 226/2 |
| 4,796,497 | 1/1989 | Morita | 83/365 |

*Primary Examiner*—Frank T. Yost
*Assistant Examiner*—Eugenia A. Jones
*Attorney, Agent, or Firm*—Luedeka, Hodges & Neely

[57] ABSTRACT

An apparatus and method for cutting segments from a strip of limp sheet material advanced lengthwise along a planar support surface utilizes a finger mechanism for ensuring that following severance of the strip from the remainder thereof, the remainder of the strip is guided along a desired path. The segments are cut from the strip by a pair of blades which move between an open condition accommodating the advancement of the strip to a position between the blades for cutting and a closed condition for cutting a segment from the strip and wherein the severed strip end is bent away from the plane of the support surface by the closing of the blades. The finger mechanism is connected to the blades so as the blades are moved from the closed condition to the open condition, the severed end of the strip is pushed by the finger mechanism from its bent position to a position corresponding with the plane of the support surface so that when the strip is subsequently advanced between the blades, the severed end is directed generally along the plane of the support surface.

6 Claims, 2 Drawing Sheets

APPARATUS FOR CUTTING A CONTINUOUS STRIP OF LIMP MATERIAL

This invention relates generally to the cutting of sheet material and relates more particularly to the cutting of a strip of limp sheet material into segments Conventional apparatus for cutting a strip of limp sheet material into segments for use, for example, as fabric labels, commonly include a support table and a knife assembly for severing the strip at a preselected location along the support table. During an operation with the apparatus, the strip is advanced lengthwise by an incremental amount along the support table to a position at which the strip is positioned in the knife assembly which is actuated to severe a segment of the strip from the remainder thereof. The steps of advancing the strip and actuating the knife assembly are thereafter repeated as additional segments are required.

The knife assembly of an apparatus of the aforedescribed type commonly includes a pair of blades mounted adjacent an edge of the support table for severing the strip as the strip is moved by an incremental amount across the edge. One of the knife blades is mounted in a stationary condition with respect to the table so that its cutting edge is located adjacent the plane of the support table, and the other blade is connected for movement relative to the stationary blade toward a closed position to sever the strip and toward an open position accommodating the advancement of the strip between the blades.

Heretofore, the strip-severing movement of the cutting edge of the movable blade across the cutting edge of the stationary blade bends the strip in the direction of blade movement and generally away from the plane of the support table If the strip does not possess sufficient resiliency or memory to return itself to a condition corresponding with the plane of the support table, its severed end may become misguided and not be directed through the apparatus in a desired manner when the strip is subsequently advanced Such a misguidance of the severed end may lead to a jamming of the apparatus or a continuance of the apparatus operation out of register.

It is an object of the present invention to provide a new and improved cutting apparatus and method for cutting a strip of limp sheet material which circumvents guidance problems associated with an inability of the strip material to return itself to a condition for advancement along a desired path following severance of the strip.

Other objects and advantages will become known by reference to the following description and the accompanying drawings.

FIG. 1 a perspective view of one embodiment of a cutting apparatus;

The apparatus of the invention includes means defining a support surface for supporting a length of a strip of limp material in a substantially planar condition for cutting. Moving means of the apparatus advances the strip lengthwise along the support surface, and a knife assembly including a pair of cutting blades severs a segment of the strip advanced across the support surface and into a position between the blades for cutting. The apparatus also includes means for actuating the knife assembly so that movement the blades to a closed condition severs the strip and movement of the blades to an opened condition accommodates advancement of the strip between the blades. During severance of the strip from the remainder thereof, the severed strip end is bent by the blades away from the plane of the support surface. In order that subsequent advancement of the strip directs the severed end through the blades in an unobstructed manner, the apparatus also includes means associated with the knife assembly for returning the bent severed end of the strip to a position corresponding with the plane of the support surface.

Figure 1:
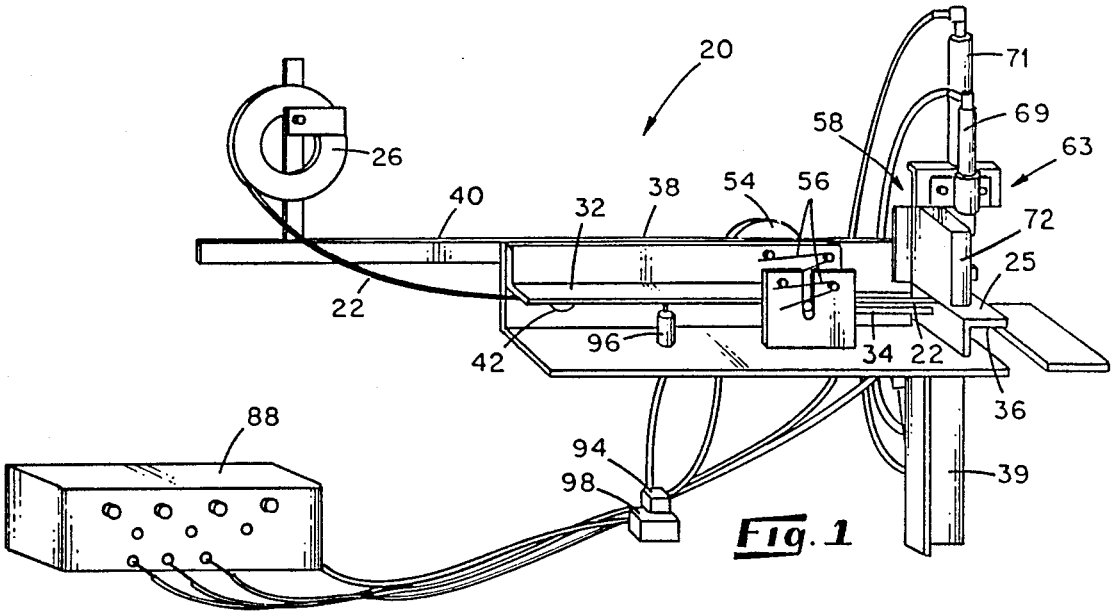
Figure 3:
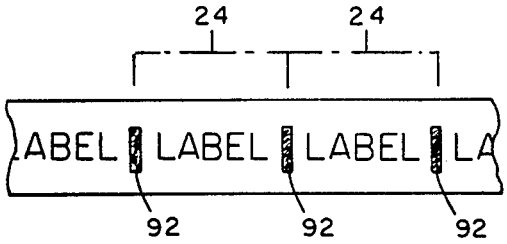
FIG. 3 is a fragmentary plan view of the strip routed through the FIG. 1 apparatus as seen generally from below in FIG. 1.

Referring now to the drawings in greater detail, there is illustrated in FIG. 1 a label-cutting apparatus, generally indicated 20, for cutting a strip 22 of limp sheet material into segments. As best shown in FIG. 3, the strip 22 consists of fabric labels 24 printed in an end-to-end arrangement so that when routed through and cut within the apparatus 20, adjacent labels 24 are separated from one another. Once separated, the labels 24 are transported from the apparatus 20 by suitable conveyor means for attachment to an item, such as a bed sheet.

With reference to FIG. 1, the apparatus 20 includes means defining a support surface 25 along which the strip 22 is moved. The support surface 25 is provided by a label support system including a downwardly-facing table 32 and a pair of upwardly-facing tables 34, 36. Each table 32, 34 or 36 is attached to a main frame 38 and supported in a horizontal orientation by means of a mount bracket 39. When moved through the apparatus, the label strip 22 is advanced along the underside of the table 32 and along the upper surfaces of the tables 34 and 36. In order that the strip 22 be moved along a generally linear path through the apparatus 20, the underside of the table 32 and the upper surfaces of the tables 34 and 36 are substantially coplanar.

As the label strip 22 is directed through the apparatus 20, the strip is dispensed from a roll 26 which is, in turn, supported to one side of the main frame 38 by a bracket 40. A guide member 42 mounted beneath the table 32 directs the movement of the strip 22 along a desired path toward the tables 34, 36, and torsion springs 44, 46, depicted in FIG. 2, mounted beneath the table 32 apply an upwardly-directed pressure to the strip 22 for holding it against the underside of the table 32. In addition, the springs 44, 46 provide a degree of resistance so that a relatively light tension is placed upon the label strip 22 as the strip 22 is moved along the table 32.

Figure 2:
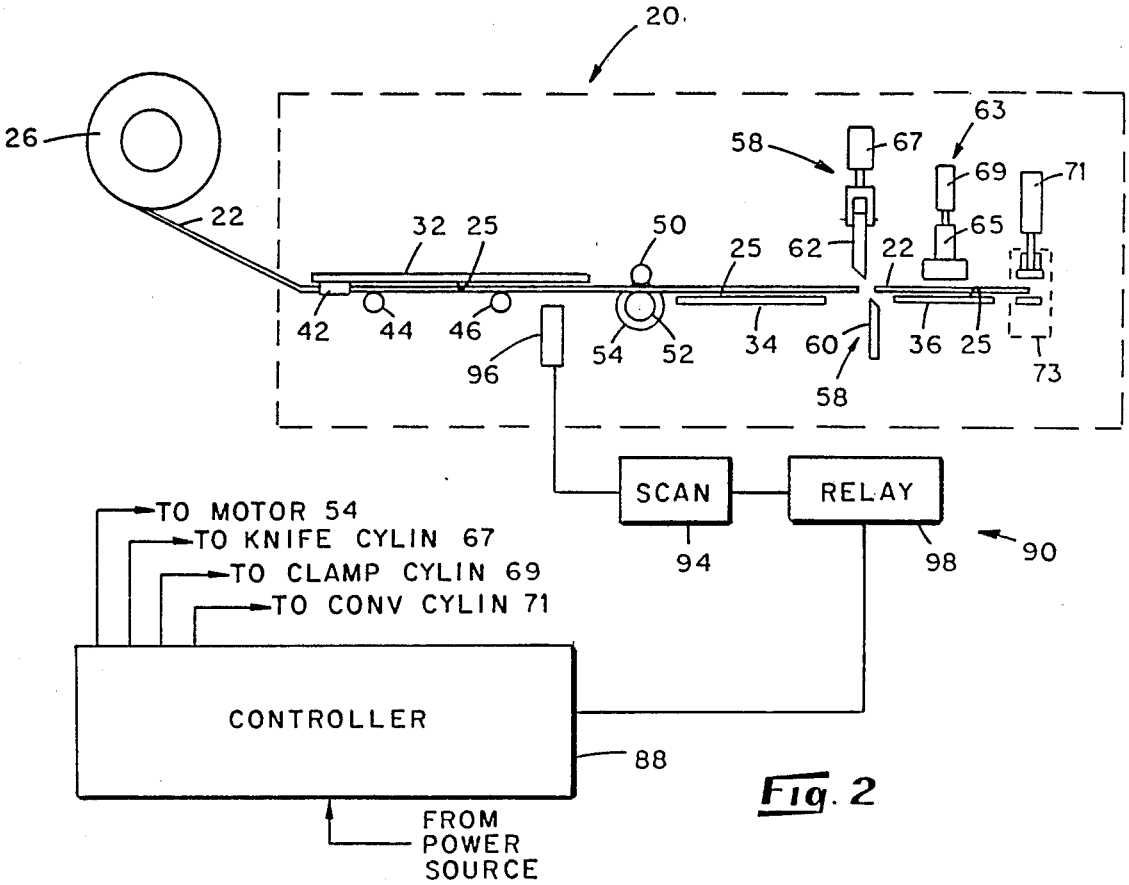
FIG. 2 is a schematic representation of the FIG. 1 cutting apparatus illustrating the path of movement followed by a strip of limp material as it moves through the apparatus.

For moving the label strip 22 through the apparatus, and with reference to FIGS. 1 and 2, the apparatus 20 includes a pair of upper and lower pull rolls 50, 52, respectively, appropriately journaled within the space defined between the tables 32 and 34 and a low speed synchronous motor 54 drivingly connected to the lower pull roll 52. The label strip 22 is directed between the surfaces of the rolls 50, 52, and springs 56 (FIG. 1) acting upon the upper roll 50 bias the surfaces of the rolls 50, 52 toward one another. Appropriate rotation of the lower pull roll 52 pulls the strip 22 along the table 32 and pushes the strip 22 along the tables 34, 36. To enhance the frictional engagement between the strip 22 and the surfaces of the rolls 50, 52, the upper pull roll 50 is constructed of nylon, and the lower pull roll 52 has a knurled surface For purposes of cutting the strip 22 into segments and with reference to FIGS. 2 and 4, the apparatus 20 includes a knife assembly 58 suitably mounted within the gap defined between the tables 34 and 36. The assembly 58 includes a pair of cutting blades 60, 62 pivotally connected together for movement relative to one another in a scissor-like fashion. Actuation of the knife assembly 58 moves the blades 60, 62 relative to one another to a closed condition to sever the strip 22 and to an opened condition to accommodate the continued advancement of the strip 22. The actuation of the knife assembly 58 is carried out by a pneumatic system having a cylinder 67 connected between the mount bracket 39 and the knife assembly 58. When the cylinder 67 is extended, the blades 60, 62 move toward the closed condition, and when the cylinder 67 is contracted, the blades 60, 62 move toward the opened condition. To enhance the safety of the apparatus 20 during actuation of the knife assembly 58, the knife assembly is housed within a blade guard 72 as shown in FIG. 1.

With reference again to FIG. 1 and FIG. 2, the apparatus 20 also includes a clamping assembly 63 for holding the portion of the strip 22 positioned between the knife assembly 58 in a stationary, planar condition for cutting The clamping assembly 63 includes a clamp 65 mounted above the table 36 for vertical movement toward and away from the table surface. Pneumatic means including a cylinder 69 are utilized for moving the clamp 65 between a lowered condition at which the strip 22 is tightly held between the clamp 65 and the surface of the table 36 for cutting and a raised condition at which the strip 22 is released and permitted to pass beneath the clamp 65.

Following the severance of a segment from the strip 22 by the knife assembly 58, the clamp 65 is raised from the table 36 and the segment is transported from the apparatus 20 by means of a conventional belt-type conveyor, indicated 73 in FIG. 2, adapted to pinch the end of the segment overhanging one edge, or the right edge as viewed in FIG. 2, and carry the segment to a desired jobsite. In the depicted embodiment 20 of FIG. 1 there is supported a pneumatic cylinder 71 for moving the conveyor 73 between a condition at which the severed strip segment is transported from the apparatus and another condition at which the next segment is positioned for transport.

The operation of the apparatus 20 is controlled by a computer 88 so that the advancement of the strip 22 and actuation of the knife assembly 58, clamp assembly 63 and conveyor cylinder 71 are automatic and coordinated. Appropriately wired to the computer 88 are optical scanning means 90 for scanning the strip 22 as it is advanced along the support surface 25 and beneath the table 32 so that the computer 88 generates and sends appropriate command signals to the various apparatus components in response to the position of the strip 22 along the support surface 25. To this end and as best shown in FIG. 3, each label 24 is segregated from its adjacent label by means of a broad, dark stripe 92 printed on the light background of the strip 22. The fiber optic scanning means 90 includes a scanner 94, a scanning head 96 supported beneath the table 32 and an appropriate relay 98 for detecting the moment at which the stripe 92 passes the head 96. At the detected moment, the computer 88 halts the pull roll motor 54 to discontinue the advancement of the strip 22. The computer 88 then moves the clamp 65 into holding engagement with the strip 22 and actuates the knife assembly 58 so that the cutting blades sever the portion of the strip 22 positioned between the blades 60, 62. It follows that the scanning head 96 and blades 60, 62 are disposed relative to one another so that upon detection of a label stripe 92 by the scanning means 90, two adjacent labels 24 are positioned between the blades 60, 62 for separation by the knife assembly 58. Following severance of a segment from the strip 22, the cutting blades 60, 62 are reopened and the conveyor cylinder 71 is actuated to transport the segment from the apparatus 20. The computer 88 then sends appropriate command signals to the motor 54 to resume the advancement of the strip 22.

Figure 4:
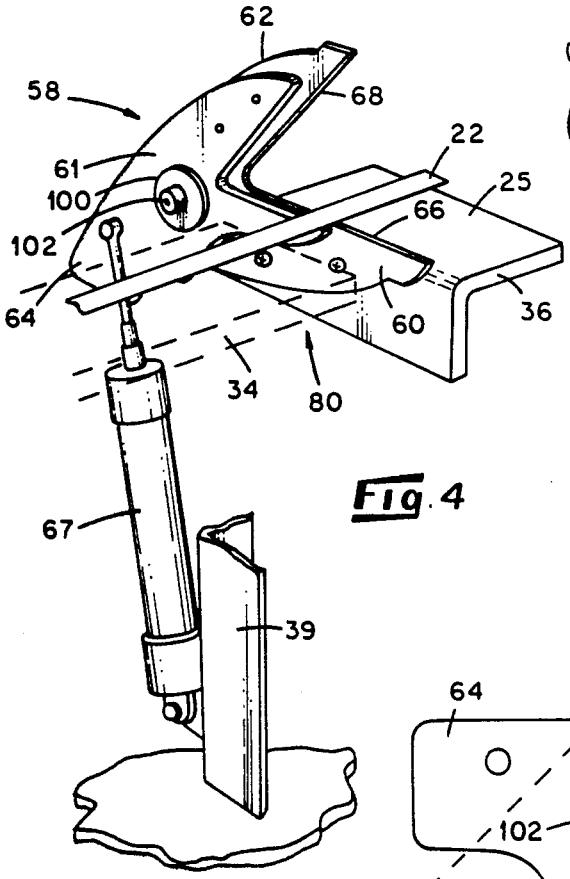
FIG. 4 is a fragmentary perspective view of the FIG. 1 cutting apparatus illustrating the knife assembly of the apparatus.
Figure 5:
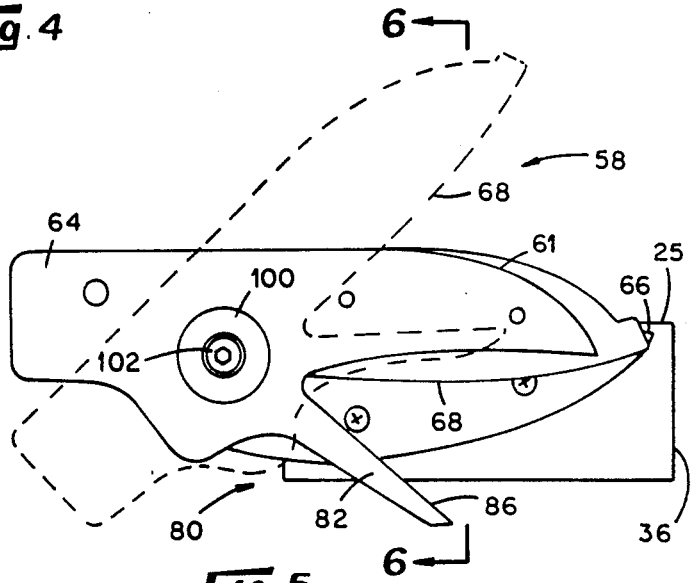
FIG. 5 is a side elevational view of the blades of the FIG. 4 knife assembly as seen generally from the left in FIG. 4.

Turning attention again to the knife assembly 58 and with reference to FIGS. 4 and 5, one blade 60 of the assembly 58 is secured in a stationary position with respect to the table 36 so that its cutting edge 66 is directed generally upwardly and is located adjacent the plane of the portion of the support surface 25 provided by the tables 34, 36. The other blade 62 is pivotally joined to the blade 60 for movement relative thereto between an opened condition as shown in phantom in FIG. 5 and a closed condition as shown in solid lines in FIG. 5. It will be understood that movement of the movable blade 62 to the closed condition effects a severance of the strip 22 positioned between the blades 60, 62 and movement of the movable blade 62 to its opened condition accommodates the advancement of the strip 22 between the blades 60, 62.

With reference still to FIG. 4, the knife assembly 58 also includes a plate member 61 fixed to one side of the movable blade 62 for movement therewith. The plate member 61 is constructed of spring steel and is adapted to bias the blades 60, 62 into engagement so that the blade cutting edges lightly press against one another as the movable blade 62 moves across the blade 60. Furthermore, the plate 61 includes an arm portion 64 extending generally opposite the tip of the blade 62, and it is to the arm portion 64 that the pneumatic cylinder 67 is connected for moving the blade 62 between the opened and closed conditions. The assembly 58 further includes a bellville spring washer 100 permitting pressure to be applied and adjusted as necessary at the pivot axis of the blade 62 as the nut 102 is tightened or loosened.

Figure 6:
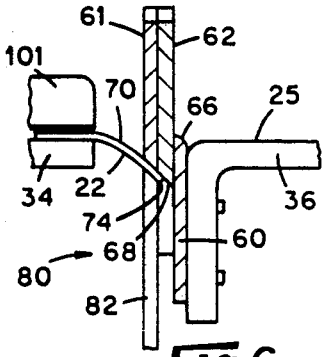
FIG. 6 is a fragmentary cross-sectional view of the knife assembly of the FIG. 1 apparatus taken about on line 6—6 of FIG. 5 and illustrating the knife assembly blades when positioned in a closed condition.

The movable blade 62 includes a generally downwardly-directed cutting edge 68 which moves across the cutting edge 66 of the stationary blade 60 as the blade 62 moves toward the closed condition. More specifically and as best shown in FIG. 6, the cutting edge 68 is movable downwardly across the cutting edge 66 so that at the lower limit of travel of the cutting edge 68, an appreciable amount of the blade 62 is positioned below the plane of the support surface 25. As a label 24 is severed from the strip 22 at the level of the cutting edge 66, the movable blade 62 presses against and bends the leading edge portion 70 (FIG. 6) of the remainder of the strip 22 downwardly. Upon completion of the cut, the blade 62 is returned to the opened condition thus relieving the downwardly-directed pressure applied to the leading edge portion 70.

Figure 7:
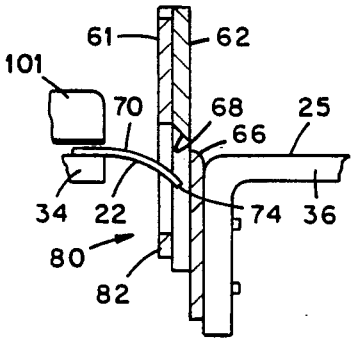
FIG. 7 is a view similar to that of FIG. 6 illustrating the knife assembly blades when positioned in a partially opened condition.

It will be appreciated that once the movable blade 62 is returned to the opened condition, subsequent advancement of the strip 22 along the support tables 34, 36 necessitates that the severed end, indicated 74 in FIG. 7, clears the cutting edge 66 of the stationary blade 60. To this end, the severed end 74 must return to about the plane of the support surface 25 so that it is positioned at least as high as the cutting edge 66 and upper surface of the table 36. If, however, the material comprising the strip 22 possesses insufficient memory or resiliency for returning the severed end 74 to about the plane of the support surface 25, additional means are needed for raising the severed end 74 by the necessary amount.

Accordingly and with reference again to FIGS. 4 and 5, the apparatus 20 includes means, generally indicated 80, associated with the knife assembly 58 for lifting the severed edge 74 of the strip 22 by a sufficient amount so that subsequent advancement of the severed end 74 along the support surface 25 clears the cutting edge 66. In the apparatus 20, the lifting means 80 includes a finger portion 82 integrally formed in the plate member 61 of the knife assembly 58 for lifting the bent severed end 74 of the strip 22 to the plane of the support surface 25 in coordination with the movement of the movable blade 62 to the opened condition. As best shown in FIG. 5, the upper surface 86 of the finger portion 82 is substantially planar and forms about a forty-five degree angle with the cutting edge 68. The movement of the cutting blade 62 is appropriately coordinated so that when the knife assembly 58 is moved to its fully opened condition, the upper surface 86 of the finger portion 82 lifts the severed end 74 slightly above the horizontal level of the cutting edge 66. LIfted to such a position, the severed end 74 clears the cutting edge 66 when advanced along the support surface 25.

Figure 8:
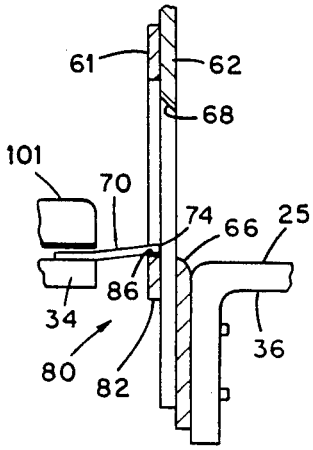
FIG. 8 is a view similar to that of FIG. 6 illustrating the knife assembly blades when positioned in a fully opened condition.

To prevent the severed strip end 74 from being moved upwardly and rearwardly with respect to the desired path of movement by the finger 82, a deflector plate 101, shown in FIGS. 6–8, is positioned above the table 34. The deflector plate 101 is constructed of a thin gauge of steel and is spaced above the surface of the table 34 so that the strip 22 can freely move along the support surface 25.

The aforedescribed operation of the finger portion 82 is depicted in FIGS. 6–8 illustrating the movable cutting blade 62 in various positions relative to the stationary blade 60. FIG. 6 illustrates the cutting blade 62 when positioned in its lowermost limit of travel at which the strip 22 is severed and leading edge portion 70 is bent downwardly. FIG. 7 illustrates the cutting blade 62 when positioned in a partially opened condition following severance of the strip 22 and illustrates the approach of the finger portion 82 toward the underside of the leading edge portion 70. FIG. 8 illustrates the cutting blade 62 when positioned in its fully opened condition so that the severed end 74 is lifted above the cutting edge 66 by the finger portion.

The method of the invention includes the steps involved in carrying out the cutting steps of the apparatus 20. Firstly, the strip 22 is advanced lengthwise along the support surface 25 to a first position between the blades 60, 62 for cutting and maintained in a substantially planar condition in the first position. The blades 60, 62 are then closed to sever a segment of the strip from the remainder thereof so that the severed end 74 of the strip 22 is bent by the blade 62 away from the plane of the aforedescribed planar condition of the strip 22. The blades 60, 62 are then opened, and the severed end 74 of the strip 22 is returned to about the plane of the aforedescribed planar condition of the strip 22. The strip 22 is subsequently advanced lengthwise to a second position between the blades 60, 62 so that the severed end 74 moves unobstructed through the blades 60, 62 and generally along the plane of the strip 22.

It will be understood that numerous modifications and substitutions can be had to the aforedescribed embodiments without departing from the spirit of the invention. For example, although the aforedescribed lifting means 80 of the apparatus 20 has been shown and described as being associated with a knife assembly 58 whose blades are pivotally movable to one another, the lift means may be associated with a knife assembly having a blade which shears the strip in an action resembling that of a guillotine. In such an embodiment, the lifting means may take the form of a bar for moving the bent strip end to a desired position in coordination with the return of the blade to a condition for cutting.

Furthermore, although the apparatus 20 has been shown and described as being used with a clamping assembly 63 and conveyor 73, the apparatus 20 may instead be used with a suitable device for folding and transporting each label. Still further, the apparatus may be assembled as either a right or left hand model. Accordingly, the aforedescribed embodiments are intended for purpose of illustration and not as limitation.

What is claimed is:

1. An apparatus for cutting a continuous strip of limp sheet material into segments, said apparatus comprising:

means defining a support surface for supporting a length of a strip of limp sheet material in a substantially planar condition for cutting, said support surface having an edge;

means for advancing the strip lengthwise along the support surface and across the edge;

a knife assembly including a pair of cutting blades supported adjacent the edge for cutting a segment of the strip from the remainder thereof when the strip is positioned between the blades so that the remainder of the strip terminates in a severed end, said blades being movable relative to one another between closed and opened conditions so that movement of the blades toward the closed condition cuts a segment from the strip and bends the severed strip end away from the plane defined by the aforesaid planar condition of the strip and so that movement of the blades toward the opened condition accommodates the advancement of the strip to a position between the blades;

means for moving the blades between the opened and closed conditions; and means associated with the knife assembly for returning the severed end of the strip to a position so that subsequent advancement of the strip along the support surface directs the severed end of the strip generally along a path of movement unobstructed by the blades;

a first of said blades being mounted in a stationary condition with respect to the support surface and a second of the blades being movable relative to the first blade between one position at which said knife assembly is in its opened condition and another position at which said knife assembly is in its closed condition, and said associated means cooperates with said second blade to return the severed strip end to the aforesaid position for advancement unobstructed by the blades; and said associated means including means defining a rigid member fixedly attached to the second blade for movement therewith between said one and another positions so that movement of said second blade from said another position to said one position effects a pushing of the severed end by said rigid member to move the severed end from the bent position to a position corresponding with the plane defined by the aforesaid planar condition of the strip.

2. An apparatus as defined in claim 1 wherein said cutting blades are generally planar and arranged in parallel planes, and said rigid member is slightly offset from the plane of said second cutting blade so that the plane of the second cutting blade is arranged generally between the rigid member and the plane of the first cutting blade.

3. An apparatus as defined in claim 2 wherein said knife assembly includes a plate-like member fixedly secured to said second blade and said rigid member is in the form of a finger formed in said plate-like member.

4. An apparatus for automatically cutting a continuous strip of limp sheet material into segments, said apparatus comprising:

means defining a substantially planar support surface for supporting a length of a strip of limp sheet material, said support surface having an edge;

means for automatically advancing the strip lengthwise along the support surface and across the edge by an incremental amount;

a knife assembly including a pair of cutting blades supported adjacent the edge for severing a segment of the strip from the remainder thereof when the strip is positioned between the blades so that the remainder of the strip terminates in a severed end, a first of said blades being mounted in a stationary condition with respect to the support surface and the second of said blades being movable relative to the first blade between one position at which said knife assembly is in an opened condition and another position at which said knife assembly is in a closed condition so that movement of the second blade from said one position to said another position moves the second blade across the first blade to sever the strip and so that the severed end of the strip is bent away from the plane of the support surface by the second blade and movement of the second blade from said another position to said one position accommodates the lengthwise movement of the strip across the edge and between the blades;

means for moving the second blade between said one and another positions; and means associated with the knife assembly for moving the severed end of the strip to a position corresponding with the plane of the support surface following severance of the strip so that the severed end is directed generally along the plane of the support surface when the strip is subsequently advanced;

said associated means including means defining a rigid member for pushing the severed end from its bent position to a position corresponding with the plane of the support surface in coordination with the movement of the second blade from said another position to said one position; and said rigid member being fixedly attached to said second blade for movement therewith between said one and another positions so that movement of said second blade from said another position to said one position effects a pushing of the severed end by said rigid member as aforesaid.

5. An apparatus as defined in claim 4 wherein said cutting blades are generally planar and arranged in parallel planes, and said rigid member is slightly offset from the plane of said second cutting blade so that the plane of the second cutting blade is arranged generally between the rigid member and the plane of the first cutting blade.

6. An apparatus as defined in claim 5 wherein said knife assembly includes a plate-like member fixedly secured to said second blade and said rigid member is formed in said plate-like member.

* * * * *